US007455473B1

(12) United States Patent
Lee et al.

(10) Patent No.: US 7,455,473 B1
(45) Date of Patent: Nov. 25, 2008

(54) METHOD OF MANUFACTURING, INSTALLING, AND EXCHANGING RUBBER SEAL FOR EXPANSION JOINT

(75) Inventors: Doo Sung Lee, Bucheon-si (KR); Jun Sung Lee, Seoul (KR); Young Seo Jeon, Seoul (KR); Yong Kul Cho, Gunpo-si (KR); Dong Joon Ko, Gunpo-si (KR)

(73) Assignee: Il-Won Tech Co., Ltd., Hwaseong-si, Gyeonggi-do (KR)

( * ) Notice: Subject to any disclaimer, the term of this patent is extended or adjusted under 35 U.S.C. 154(b) by 0 days.

(21) Appl. No.: 11/898,821

(22) Filed: Sep. 17, 2007

(51) Int. Cl.
*E01C 11/24* (2006.01)

(52) U.S. Cl. ..... 404/2; 404/4

(58) Field of Classification Search ..... 404/2, 404/4, 7; 14/77.1; 405/118
See application file for complete search history.

(56) References Cited

U.S. PATENT DOCUMENTS 4,007,994 A * 2/1977 Brown ..... 404/69
4,533,278 A * 8/1985 Corsover et al. ..... 404/65
5,213,438 A * 5/1993 Barenwald ..... 404/2
5,806,252 A * 9/1998 Scuero ..... 52/169.7
5,853,265 A * 12/1998 Gunter ..... 405/118
6,722,818 B1 * 4/2004 Suazo et al. ..... 405/121
6,755,596 B2 * 6/2004 Schibi ..... 405/270

* cited by examiner

*Primary Examiner*—Raymond W Addie
(74) *Attorney, Agent, or Firm*—Bacon & Thomas, PLLC

(57) ABSTRACT

A method of installing or exchanging a rubber seal for an expansion joint is provided, which includes installing guide rails for detachably mounting the rubber seal on both vertical parts of lower plates, installing a plurality of guide rollers at both ends of the rubber seal in a longitudinal direction thereof using guide roller fixing members to slidably fix the rubber seal to the guide rails, suspending wires from a lower one side of the expansion joint to an opposite side thereof to a sufficient length to pull the rubber seal, fastening one end of the wire to a wire hole of the guide roller fixing member coupled to the rubber seal from a start point of pushing the rubber seal, inserting a portion of the guide roller fastened to the wire into one start point of the guide rail and pulling the wire from the other termination point of the guide rail, and after inserting the rubber seal, cutting the rubber seal to the length between both ends of the guide rail or the length of the expansion joint and fixing the rubber seal.

6 Claims, 6 Drawing Sheets

Prior Art

METHOD OF MANUFACTURING, INSTALLING, AND EXCHANGING RUBBER SEAL FOR EXPANSION JOINT

BACKGROUND OF THE INVENTION

1. Field of the Invention

The present invention relates to an expansion joint used in bridges or elevated roads, and more particularly, to a method of installing or exchanging a rubber seal for an expansion joint, which is capable of preventing secondary damage to a lower structure due to traffic jam caused by traffic control and delayed exchange of a damaged rubber seal member by improving a rubber seal for collecting rainwater and foreign substances in a structure exchangeable independently from the expansion joint.

2. Description of Related Art

Generally, a relatively long bridge having a plurality of piers has a plurality of deck slabs divided in a longitudinal direction thereof in order to deal with expansion and shrinkage of the bridge caused by temperature variation. Expansion joints are installed between the deck slabs.

FIG. 1 is a view showing a structure of a conventional expansion joint for a bridge and an installation state of a rubber seal.

Referring to FIG. 1, the conventional expansion joint for a bridge includes upper cover plates 101*a* and 101*b* installed at opposite ends of the deck slabs to be coupled to each other and expandable according to temperature variation, anchor bolts 102 for fastening the upper cover plates 101*a* and 101*b* to after-cured concretes 105, reinforcement iron rods 103 for increasing a fastening force between the anchor bolts 102 and the after-cured concretes 105 and reinforcing strength of the after-cured concretes 105, and a rainwater and foreign substances collecting rubber seal 104 fixed to the after-cured concretes 105 at both ends thereof. Designated by reference numeral 106 are reinforcing rods disposed in the deck slabs of the bridge.

In the conventional expansion joint for a bridge having the structure as above, after anchor-coupling the rubber seal 104 to a concrete slab before installing the upper cover plates 101*a* and 101*b*, the upper cover plates 101*a* and 101*b* are installed and nuts are fastened to the anchor bolt 102, thereby completing installation of the expansion joint. Therefore, when the rubber seal 104 is damaged, the upper cover plates 101*a* and 101*b* need to be opened to exchange the damaged rubber seal 104 after traffic control. In addition, the damaged rubber seal may cause rainwater leakage and thus additional damage to a lower structure.

FIG. 2 is a view showing a structure of another conventional expansion joint for a bridge and an installation state of a rubber seal.

Referring to FIG. 2, another conventional expansion joint for a bridge is inserted into a gap between opposite upper plates, and includes main bodies 201 expandable depending on temperature variation, anchors 202 for fixing the main bodies 201 of the expansion joint to after-cured concretes 205, reinforcement iron rods 203 for increasing a fastening force between the anchors 202 and the after-cured concretes 205 and reinforcing strength of the after-cured concretes 205, and a rainwater and foreign substance collecting rubber seal 204 installed at the after-cured concretes 205 integrally with the main bodies 201. Indicated by reference numeral 206 are reinforcing rods disposed in the deck slabs of the bridge.

In another conventional expansion joint for a bridge having the structure as above, when the rubber seal 204 is damaged, it is impossible to exchange only the damaged rubber seal 204, like the conventional expansion joint of FIG. 1. Therefore, the after-cured concretes 205 are first broken and the main bodies 201 of the expansion joint are removed. Then, new main bodies 201 of the expansion joint are installed again, the reinforcement iron rods 203 are distributed again, after-cured concretes 205 are poured and cured, and then, vehicles can pass therethrough after curing. Therefore, another conventional expansion joint for a bridge gives rise to several problems such as traffic control for many hours due to such maintenance, increase in maintenance cost caused by exchange of the entire expansion joint, and reduction in lifespan of the bridge due to frequent repairs. In addition, late maintenance of the damaged part causes leakage of water and thus secondary damage to lower structures. Moreover, even though the main body 201 of the expansion joint is maintained in good condition, the entire expansion joint has to be exchanged due to the damage to the rubber seal 204, thus remarkably increasing maintenance cost.

SUMMARY OF THE INVENTION

The present invention has been made in view of the above drawbacks, and it is, therefore, an object of the present invention to provide a method of installing or exchanging a rubber seal for an expansion joint, which is capable of preventing secondary damage to a lower structure due to traffic jam caused by traffic control and delayed exchange of a damaged rubber seal member by improving a rubber seal for collecting rainwater and foreign substances in a structure exchangeable independently from the expansion joint.

According to the present invention for achieving the above object, there is provided a method of installing or exchanging a rubber seal for an expansion joint, the expansion joint comprising finger-type upper plates which are disposed at both ends of opposite deck slabs of a bridge or an elevated road to be engaged with each other, and can be adapted to various expansion joints expandable depending on temperature variation; lower plates installed under the upper plates to fixedly support the upper plates, each of which has a key part closely fixing a rear plate end of a finger part of the upper plate, a horizontal part extending from the key part to support the upper plate in a contact manner, and a vertical part perpendicularly extending from the horizontal part; vertical anchors vertically installed under the horizontal parts of the lower plates to fix the upper plates and the lower plates to an after-cured concrete; horizontal anchors horizontally installed under the lower plates to fix the lower plates to the after-cured concrete; and a rubber seal installed under the upper plates to collect rainwater and foreign substances, the method comprising the steps of: (a) installing guide rails for detachably mounting the rubber seal on both vertical parts of the lower plates; (b) installing a plurality of guide rollers at both ends of the rubber seal in a longitudinal direction thereof using guide roller fixing members to slidably fix the rubber seal to the guide rails; (c) suspending wires from a lower one side of the expansion joint to an opposite side thereof to a sufficient length to pull the rubber seal; (d) fastening one end of the wire to a wire hole of the guide roller fixing member coupled to the rubber seal from a start point of pushing the rubber seal; (e) inserting a portion of the guide roller fastened to the wire into one start point of the guide rail and pulling the wire from the other termination point of the guide rail; and (f) after inserting the rubber seal, cutting the rubber seal to the length of the guide rail or the length of the expansion joint and fixing the rubber seal.

DESCRIPTION OF SPECIFIC EMBODIMENTS

Hereinafter, preferred embodiments of the present invention will be described in detail with reference to the accompanying drawings.

Figure 1:
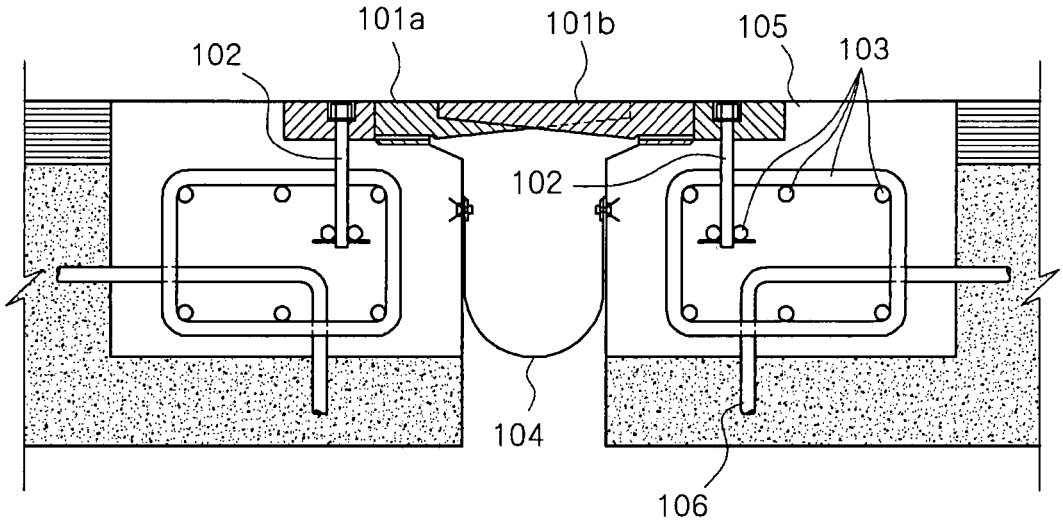
FIG. 1 is a cross-sectional view illustrating a structure of a conventional expansion joint for a bridge and an installation state of a rubber seal.
Figure 2:
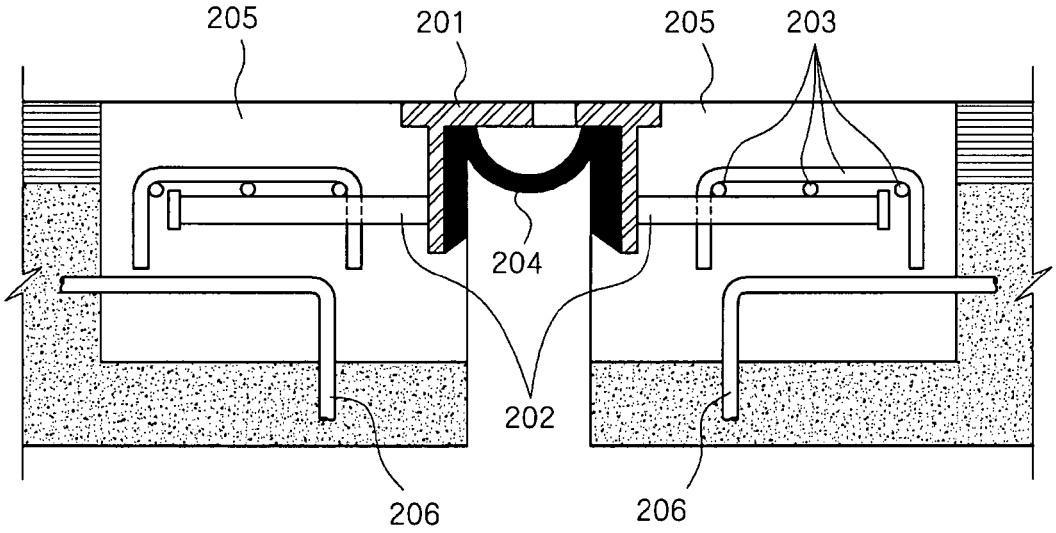
Prior Art Fig. 2
FIG. 2 is a cross-sectional view showing a structure of another conventional expansion joint for a bridge and an installation state of another rubber seal.
Figure 3:
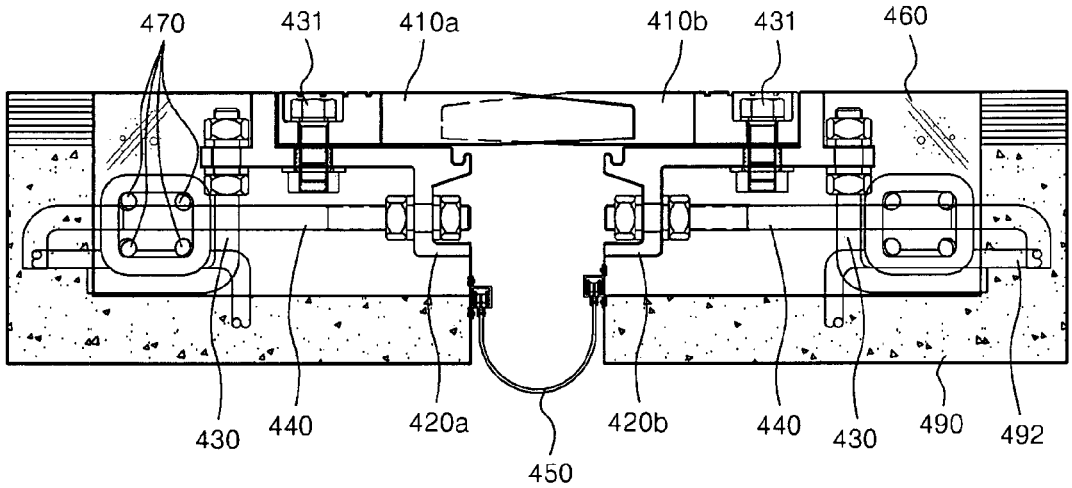
FIG. 3 is a cross-sectional view showing an installed (or exchanged) state of a rubber seal through a method of installing or exchanging a rubber seal for an expansion joint according to an exemplary embodiment of the present invention.
Figure 4:
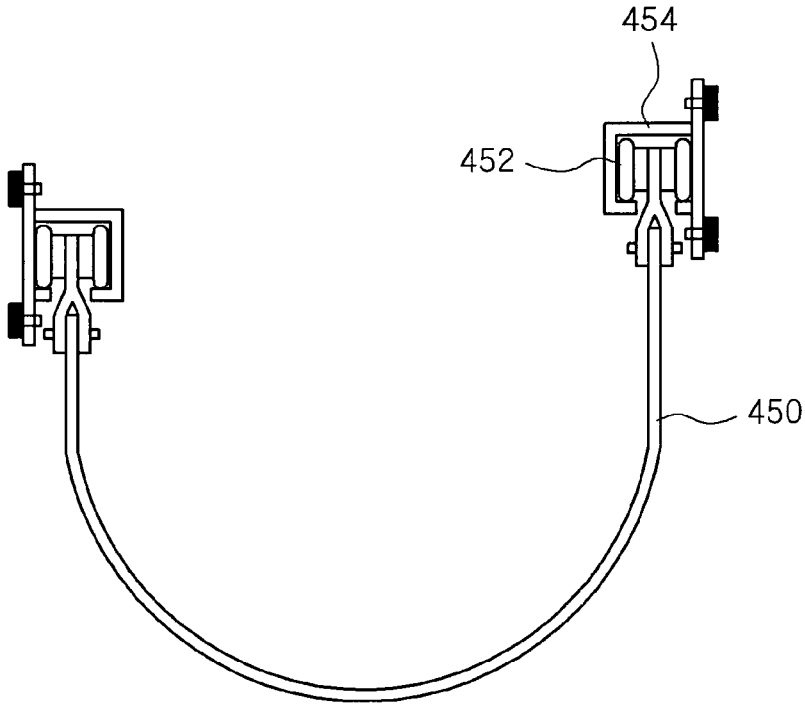
FIG. 4 is a view showing a detachable installation mechanism of the rubber seal applied to the method according to the present invention.
Figure 5:
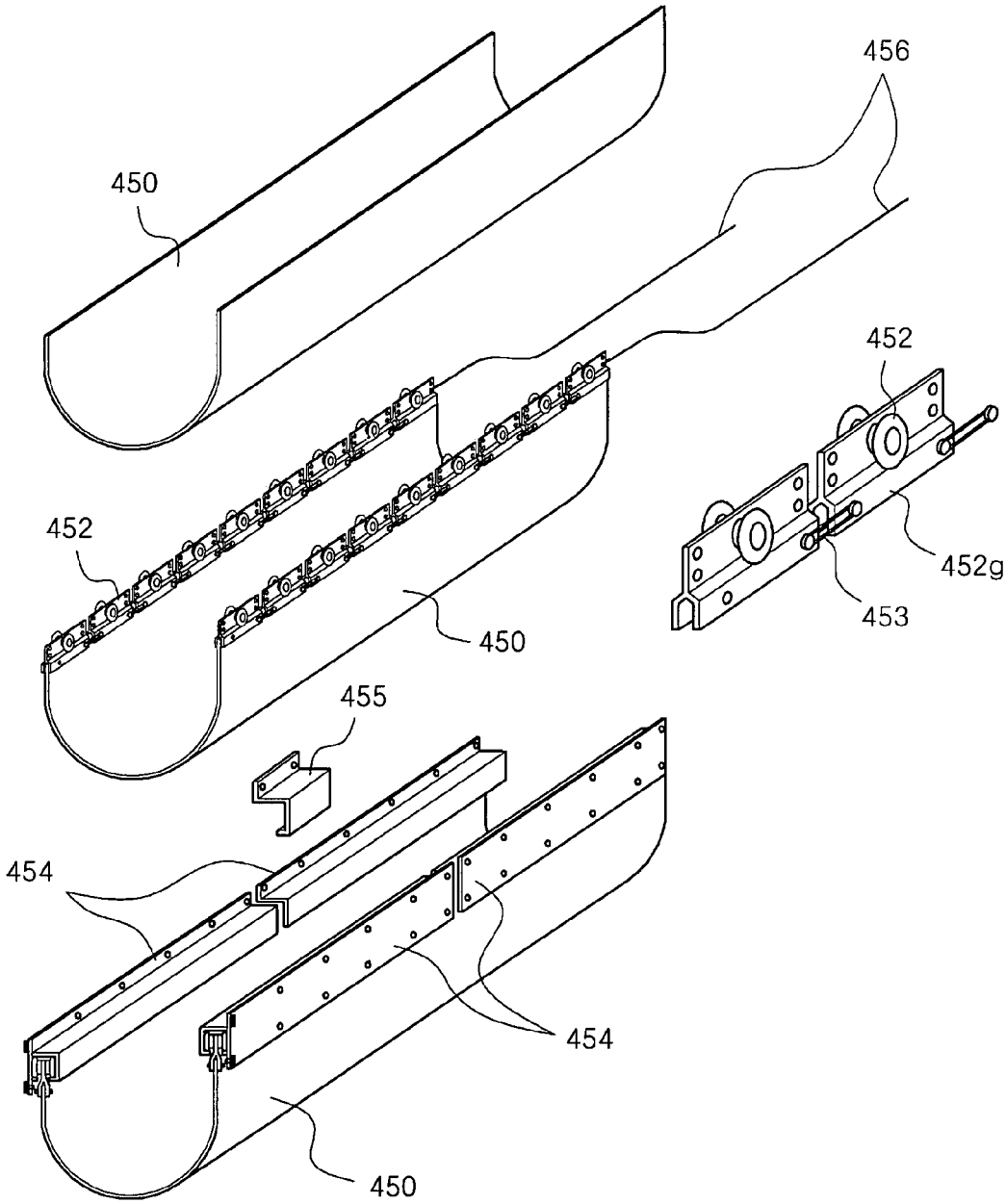
FIG. 5 is an exploded perspective view showing the rubber seal, a guide roller, and a guide rail adapted to the method according to the present invention.

FIG. 3 is a cross-sectional view showing an installed (or exchanged) state of a rubber seal through a method of installing or exchanging a rubber seal for an expansion joint according to a preferred embodiment of the present invention, FIG. 4 is a view showing a detachable installation mechanism of the rubber seal adapted to the method according to the present invention, and FIG. 5 is an exploded perspective view showing the rubber seal, a guide roller, and a guide rail adapted to the method according to the present invention.

Referring to FIGS. 3 to 5, in the method of installing or exchanging a rubber seal for an expansion joint according to the present invention, the expansion joint includes finger-type upper plates 410*a* and 410*b* which are disposed at both ends of opposite deck slabs of a bridge or an elevated road to be engaged with each other, and can be adapted to various expansion joints expandable depending on temperature variation; lower plates 420*a* and 420*b* installed under the upper plates 410*a* and 410*b* to fixedly support the upper plates 410*a* and 410*b*, each of which has a key part closely fixing a rear plate end of a finger part of the upper plates 410*a* and 410*b*, a horizontal part extending from the key part to support the upper plate in a contact manner, and a vertical part perpendicularly extending from the horizontal part; vertical anchors 430 vertically installed under the horizontal parts of the lower plates 420*a* and 420*b* to fix the upper plates 410*a* and 410*b* and the lower plates 420*a* and 420*b* to an after-cured concrete 460; horizontal anchors 440 horizontally installed under the lower plates 420*a* and 420*b* to fix the lower plates 420*a* and 420*b* to the after-cured concrete 460; and a rubber seal 450 installed under the upper plates 410*a* and 410*b* to collect rainwater and foreign substances.

The method of installing and exchanging the rubber seal 450 for the expansion joint having the structure as above includes the steps of: installing guide rails 454 for detachably mounting the rubber seal 450 on both vertical parts of the lower plates 420*a* and 420*b*; installing a plurality of guide rollers 452 at both ends of the rubber seal 450 in a longitudinal direction thereof using guide roller fixing members 452*g* to slidably fix the rubber seal 450 to the guide rails 454; suspending wires (for example, steel wires or piano wires) 456 from a lower one side of the expansion joint to an opposite side thereof to a sufficient length to pull the rubber seal 450; fastening one end of the wire 456 to a wire hole of the guide roller fixing member 452*g* coupled to the rubber seal 450 from a start point of pushing the rubber seal 450; inserting a portion of the guide roller 452 fastened to the wire 456 into one start point of the guide rail 454 and pulling the wire 456 from the other termination point of the guide rail 454; and after inserting the rubber seal 450, cutting the rubber seal 450 to the length of the guide rail 454 or the length of the expansion joint and fixing the rubber seal 450. As a result, a series of processes of the method of installing and exchanging a rubber seal are completed.

Here, the forgoing is the description for the novel installation of the rubber seal 450. Of course, when the rubber seal 450 is exchanged and foreign substances are removed from the rubber seal 450, the above steps can be repeatedly performed, thereby achieving the purposes.

In FIGS. 3 to 5, reference numeral 431 designates bolts for fastening the deck slabs to the vertical anchors, reference numeral 455 designates a coupling for connecting the guide rails to each other, reference numeral 470 designates reinforcement iron rods, reference numeral 490 designates concrete slabs, and reference numeral 492 designates slab iron rods.

Further, as for the method of installing and exchanging a rubber seal according to the present invention, a more detailed description of manufacture and installation of the rubber seal 450 and the guide rail 454 will be described.

First, in manufacturing the rubber seal 450, as shown in FIG. 5, after press fitting the guide roller fixing members 452*g*, to which the guide rollers 452 are attached, into an upper end of the rubber seal 450, the guide roller fixing members 452*g* are press fitted into the rubber seal 450 using rubber fixing pins (screw). Then, the guide roller fixing members 452*g* are connected to each other by flexible connection rings 453 formed of a resin material. In addition, the guide roller fixing member 453*g* is manufactured such that its length can be adjusted depending on field conditions, thereby acquiring the effect capable of being bent to some extent during conveyance and installation.

In manufacturing the guide rail 454, in the case of an exposed guide rail as in FIGS. 6A and 6B to be described later, a corrosion resistance material, for example, stainless steel, aluminum, or a resin-based material, is used to maintain sealing to prevent introduction of rainwater from an upper part thereof. While the guide rail 454 is basically extruded in a factory, the guide rail 454 should have the length sufficient to prevent its deformation and to be readily conveyed and installed. In addition, the guide rail 454 needs to be attached to the concrete slab by the anchor. Further, when a space is too narrow to attach the guide rail, the guide rail may be attached to the vertical part of the lower plate by welding or bolts. At this time, in the case of the exposed guide rails, when the opposite guide rails do not interfere with each other even though the expansion joints maximally approach each other, the guide rails are disposed to have the same height. When the guide rails interfere with each other, they are disposed at different heights. Connection between the guide rails 454 is made using a separate coupling 455 to prevent introduction of rainwater or foreign substances into the guide rails and secure smooth rotation of the guide roller 452: In addition, when the guide rails 454 are fixed to the vertical parts of the concrete slabs, the guide rails are fixed along the same length as the assembly length of the expansion joints.

Figure 6A:
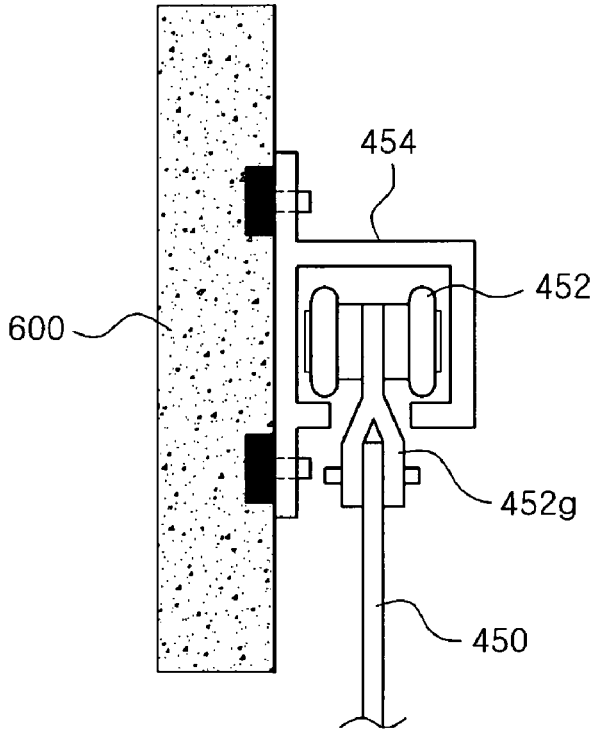
FIGS. 6A to 6C are views showing various installation examples of the rubber seal according to the method of the present invention.
Figure 6B:
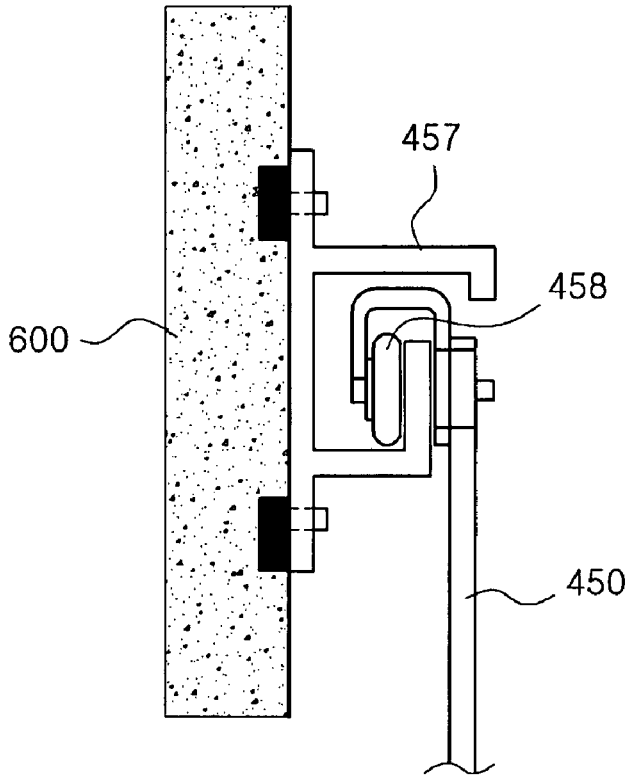
Figure 6C:
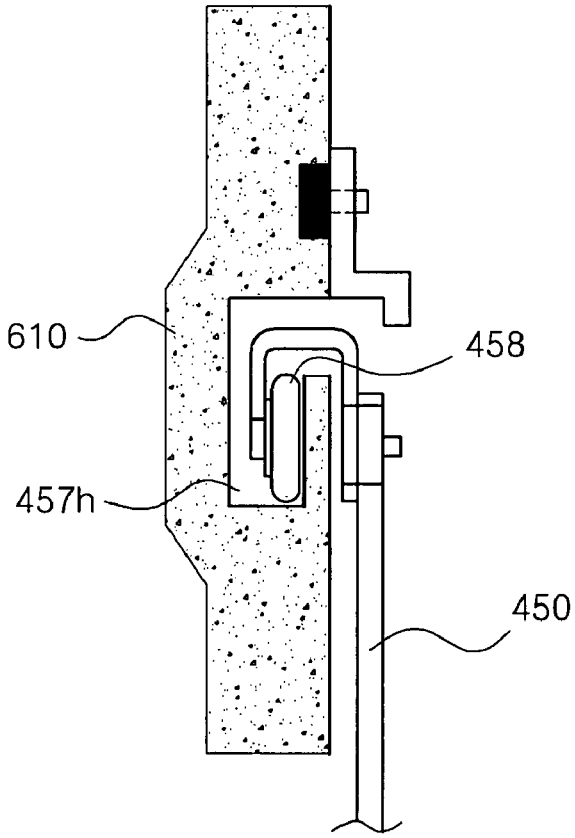

FIGS. 6A to 6C are views showing various installation examples of the rubber seal according to the present invention.

Referring to FIG. 6A, there is shown a closed guide rail (a basic guide rail) 454 which includes a guide roller 452 having two wheels. At this time, the guide rail 454 is fixed to a steel main body or a concrete wall 600.

Referring to FIG. 6B, there is a ring-shaped guide rail 457 which includes a guide roller 458 having a single wheel. At this time, the guide rail 457 is also fixed to a steel main body or a concrete wall 600, like the closed guide rail.

Referring to FIG. 6C, there is a buried guide rail 458 which has a guide groove 457*h* corresponding to the ring-shaped guide rail 457 of FIG. 6B formed in a steel main body 610. That is, the guide roller 458 is buried into the steel main body 610, which is different from that of the exposed guide rails of FIGS. 6A and 6B.

As described above, the respective coupling mechanisms of the guide rails and the guide rollers have substantially the same function and effect although they may have appropriate constitutions depending on conditions of bridges or other concrete structures, and construction sites.

Figure 7:
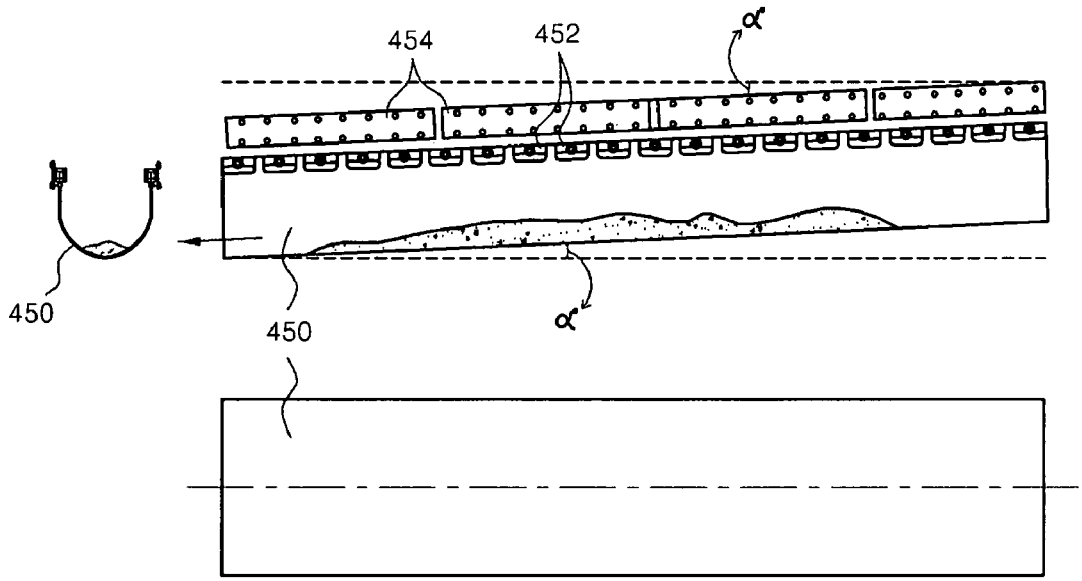
FIG. 7 is a view showing a case in which the guide rail and the rubber seal are designed and manufactured in a rectangular shape, and installed in a sloped manner according to the method of the present invention.
Figure 8:
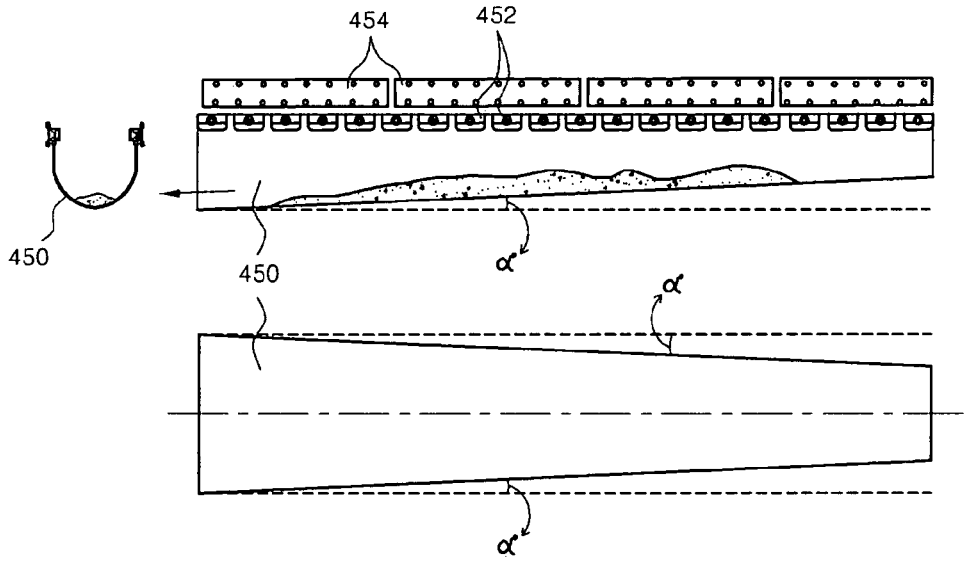
FIG. 8 is a view showing a case in which the rubber seal are designed and manufactured to be sloped, and installed at a horizontal guide rail according to the method of the present invention.

Meanwhile, in installation of the guide rails 454, as shown in FIG. 7, the guide rails 454 are sloped to a predetermined slant angle $\alpha°$ with respect to a horizontal surface such that the rubber seal 450 is sloped. This is to smoothly discharge the foreign substances and rainwater introduced into the rubber seal 450. For this purpose, as shown in FIG. 8, the guide rails 454 are horizontally installed and the rubber seal 450 is designed and manufactured to be sloped to a predetermined angle $\alpha°$ and then fastened to the guide rails 454 as the case may be, thereby obtaining the same effect as the guide rails 454 of FIG. 7 (i.e., the entire rubber seal is installed in a sloped manner).

Figure 9:
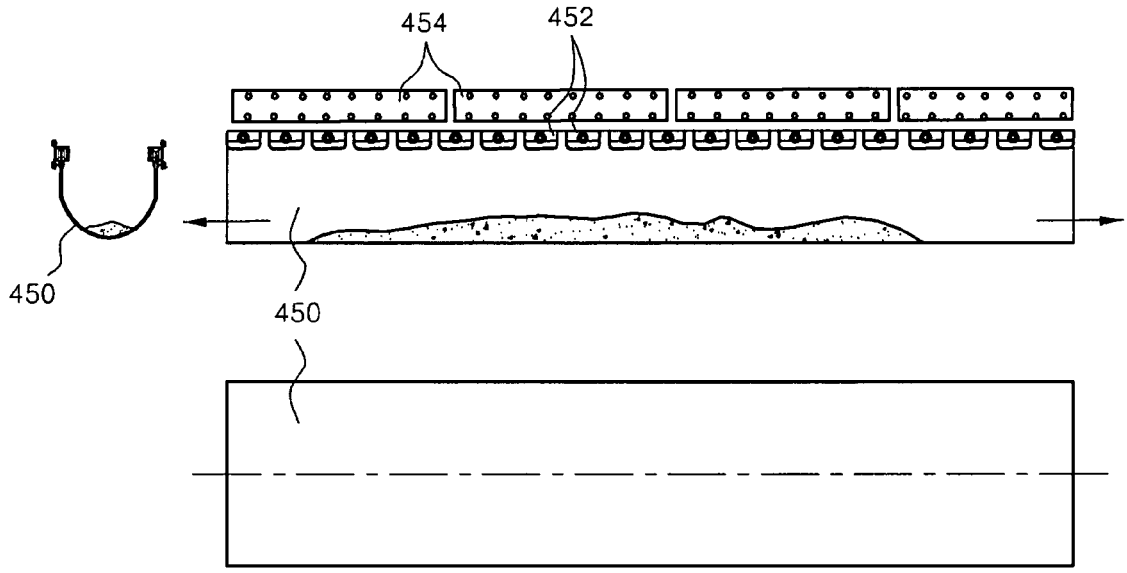
FIG. 9 is a view showing a case in which the rubber seal manufactured in a rectangular shape is installed at a horizontal guide rail according to the method of the present invention.

In addition, as shown in FIG. 9, the guide rails 454 may be horizontally installed, and the rubber seal 450 having a rectangular shape may also be horizontally installed as the case may be. As such, when both the guide rails 454 and the rubber seal 450 are horizontally installed, dual side drainage is possible while the structures in FIGS. 7 and 8 are suitable for the single side drainage.

As can be seen from the foregoing, the method of installing or exchanging a rubber seal for an expansion joint according to the present invention is used for collecting rainwater and foreign substances, and includes installing guide rollers at both sides of the rubber seal such that the guide rollers can be exchanged dependently from a main body of the expansion joint, and installing guide rails corresponding to the guide rollers at a lower steel body of a deck slab or a concrete wall such that the rubber seal can be slidably installed and exchanged, thereby enabling installation or exchange of the rubber seal regardless of the traffic control. As a result, it is possible to fundamentally prevent secondary damage to a lower structure due to traffic jam caused by traffic control in exchange of a rubber seal in the existing expansion joint, and delayed exchange of a damaged rubber seal.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A method of installing or exchanging a rubber seal for an expansion joint, the expansion joint comprising finger-type upper plates which are disposed at both ends of opposite deck slabs of a bridge or an elevated road to be engaged with each other, and can be adapted to various expansion joints expandable depending on temperature variation; lower plates installed under the upper plates to fixedly support the upper plates, each of which has a key part closely fixing a rear plate end of a finger part of the upper plate, a horizontal part extending from the key part to support the upper plate in a contact manner, and a vertical part perpendicularly extending from the horizontal part; vertical anchors vertically installed under the horizontal parts of the lower plates to fix the upper plates and the lower plates to an after-cured concrete; horizontal anchors horizontally installed under the lower plates to fix the lower plates to the after-cured concrete; and a rubber seal installed under the upper plates to collect rainwater and foreign substances, the method comprising the steps of:

(a) installing guide rails for detachably mounting the rubber seal on both vertical parts of the lower plates;

(b) installing a plurality of guide rollers at both ends of the rubber seal in a longitudinal direction thereof using guide roller fixing members to slidably fix the rubber seal to the guide rails;

(c) suspending wires from a lower one side of the expansion joint to an opposite side thereof to a sufficient length to pull the rubber seal;

(d) fastening one end of the wire to a wire hole of the guide roller fixing member coupled to the rubber seal from a start point of pushing the rubber seal;

(e) inserting a portion of the guide roller fastened to the wire into one start point of the guide rail and pulling the wire from the other termination point of the guide rail; and (f) after inserting the rubber seal, cutting the rubber seal to the length of the guide rail or the length of the expansion joint and fixing the rubber seal.

2. The method of claim 1, wherein, in the step (a) of installing the guide rails for mounting the rubber seal, the guide rails are sloped to a predetermined angle $\alpha°$ with respect to a horizontal surface to smoothly discharge foreign substances and rainwater introduced into the rubber seal.

3. The method of claim 1, wherein, in the steps (a) to (f) of installing the rubber seal at the guide rails, the guide rails are horizontally installed and the rubber seal is designed and manufactured to be sloped to a predetermined angle $\alpha°$ and then fastened to the guide rails to smoothly discharge foreign substances and rainwater introduced into the rubber seal.

4. The method of claim 1, wherein, in the steps (a) to (f) of installing the rubber seal at the guide rails, the guide rails are horizontally installed and the rubber seal having a rectangular shape is also horizontally installed.

5. The method of claim 1, wherein, in the step (b) of installing the plurality of guide rollers at both ends of the rubber seal, after inserting the guide roller fixing members, to which the guide rollers are attached, into upper ends of the rubber seal, the rubber seal and the guide roller fixing members are press fitted using a rubber fixing pin (screw).

6. The method of claim 1, wherein the steps (b) to (f) are repeatedly performed so as to exchange the rubber seal or remove the foreign substances from the rubber seal.

* * * * *